United States Patent [19]

Orchard

[11] Patent Number: 4,789,813

[45] Date of Patent: Dec. 6, 1988

[54] APPARATUS FOR TENSION CONTROL OF A FLEXIBLE MATERIAL DURING WINDING OR UNWINDING FROM A DRUM OR REEL

[75] Inventor: Owen J. Orchard, Chinnor, England

[73] Assignee: Beta Instruments Co., Ltd., Bucks, England

[21] Appl. No.: 937,070

[22] Filed: Dec. 2, 1986

[30] Foreign Application Priority Data

Dec. 3, 1985 [GB] United Kingdom ..... 8529782

[51] Int. Cl.[4] ..... B65H 59/38

[52] U.S. Cl. ..... 318/6; 242/75.51

[58] Field of Search ..... 318/6, 7; 242/75.51

[56] References Cited

U.S. PATENT DOCUMENTS

| | | | |
|---|---|---|---|
| 2,844,773 | 7/1958 | Turner et al. | 318/6 |
| 2,981,491 | 4/1961 | Eans | 318/6 X |
| 3,348,107 | 10/1967 | Hamby | 318/6 |
| 4,196,375 | 4/1980 | Findeisen | 318/6 |

*Primary Examiner*—Bentsu Ro

*Attorney, Agent, or Firm*—Stanley J. Price, Jr.

[57] ABSTRACT

Apparatus for controlling the tension of travelling filamentary material such as that being unwound from a drum or spool. It comprises a three phase induction motor for turning the drum or spool modified to have a high resistance rotor providing a torque speed characteristic of falling torque with increasing speed. The motor drive, and torque in either forward or reverse drive, is controlled by a pair of thyristor banks selectively triggered for forward and reverse drive modes by error signals representative of variation in tension from the required value.

6 Claims, 2 Drawing Sheets

APPARATUS FOR TENSION CONTROL OF A FLEXIBLE MATERIAL DURING WINDING OR UNWINDING FROM A DRUM OR REEL

FIELD OF THE INVENTION

The present invention relates to apparatus for controlling the tension in a flexible material as it is wound or unwound from a drum or reel irrespective of the speed or the weight and size of the drum within the design limitations of the system.

BACKGROUND OF THE INVENTION

The need for a system of the above type is borne out by the fact that certain material, namely glass fibres, plastic fibres, fine metallic wires and filaments, are normally manufactured and wound on to drums or spools for handling and storing. Moreover once these materials are required to be processed and made into a cable or strand, they have to be payed-off from the stored spools into the process which will transform them into another product.

It is during this unwinding (and also the previous winding) process that care must be takn not to stress the material mechanically as this will either impair the future optical, electrical or mechanical properties of the fibre or, at worst, will break the fibre completely.

It is in this area that a accurate system is required which would perform this duty and thus for example render the fibre being paid-off at constant tension producing a constant characteristic pay-off and enabling the required parameters of the final product to be within specified limits.

As a practical example, consider an optical fibre, which is a glass material of certain refractive index and of the order of 100–200 microns in diameter and which, after manufacture, is to be put into cable form. The eventual cable may contain 5, 10 or 20 of these fibres, each payed-off into an extruder. The extruder then extrudes the material and forms a cable which may be used for data transmission or communications.

For paying-off each individual fibre, a tension control system is required that maintains tension at a few grams, ie 15 or 20 gm, continuously throughout the pay-off process irrespective of acceleration or speed and independently of the weight or size of the spool. The fibre is very fragile, therefore it is very important that the system can maintain this tension without any deviation.

Previous systems in existence include tension control pay-off's employing DC motors such as described in UK Patent No. 1194771.

This prior system was designed essentially for paying-off metallic wire and had tension control requirements in the range 1 to 5 kg. Thus deviation from the range was not critical since the material being payed-off was not fragile or ductile.

Current needs however require a more precise and accurate method of tension control because of the different and varying characteristics of the material to be handled namely that of fragility as mentioned above.

The prior system discussed above is not capable of providing these needs due primarily to the use of a DC motor.

Amongst other disadvantages of employing D.C. machines where sensitivity of operation is essential, is the inclination to cog at low speeds. Moreover hot spots are created in the brushes and commutators and "lurched starting" occurs from stop. The brushes themselves carbonize at zero or low speed, creating high resistance hot spots and ensuing discontinuity rendering the sytem unusable.

SUMMARY OF THE INVENTION

It is an object of the invention to obviate the disadvantages of the prior art and to provide a tension control sytem for travelling flexible material of wider application particularly in controlling the tension of material of filamentary form with a high degree of sensitivity and accuracy.

According to the invention there is provided apparatus for controlling the tension of flexible materials during winding and unwinding processes comprising an electric motor drivably coupled to a spool or reel onto or from which a flexible material is to be wound or unwound respectively to drive the spool or reel, characterised in that the motor is an A.C. motor, detector means for detecting changes in the tension of the flexible material form a predetermined value during winding or unwinding and providing output signals representative thereof, and control means operatively responsive to said output signals to control the drive of said A.C. motor thereby to maintain the tension of the material being wound or unwound at said predetermined value.

The use of an A.C. induction motor removes the problems of D.C. motor control as enumerated above, and by increasing the inherent rotor resistance, the normal torque speed characteristics may be altered so that torque decreases with increasing speed from start.

Control of the output torque of the induction motor is achieved by the control means preferably including a pair of thyristor banks operating selectively on two phases of the three phase induction motor, one for forward and one for reverse drive, with a phase shift actuating device, such as a capactor, between the outputs of the thyristor banks to act as the phase determinant of the two phase windings depending on which thyristor bank is energised for forward and reverse drive.

In response to variation of tension in the travelling material from a predetermined value, the forward drive thyristor bank is selectively energised to provide an output voltage varying the output torque through the phase windings to either increase or decrease forward drive as the case may be.

Due to modification of the rotor resistance as explained earlier to provide particular torque speed characteristics, smooth and stable operational variation of motor torque is achievable on a continuous basis thereby to maintain accurate control over the required tension of the travelling filamentary material.

BRIEF DESCRIPTION OF THE DRAWINGS

The invention will now be described by way of example with reference to the accompanying drawings wherein.

BEST MODES OF CARRYING OUT THE INVENTION

Figure 1:
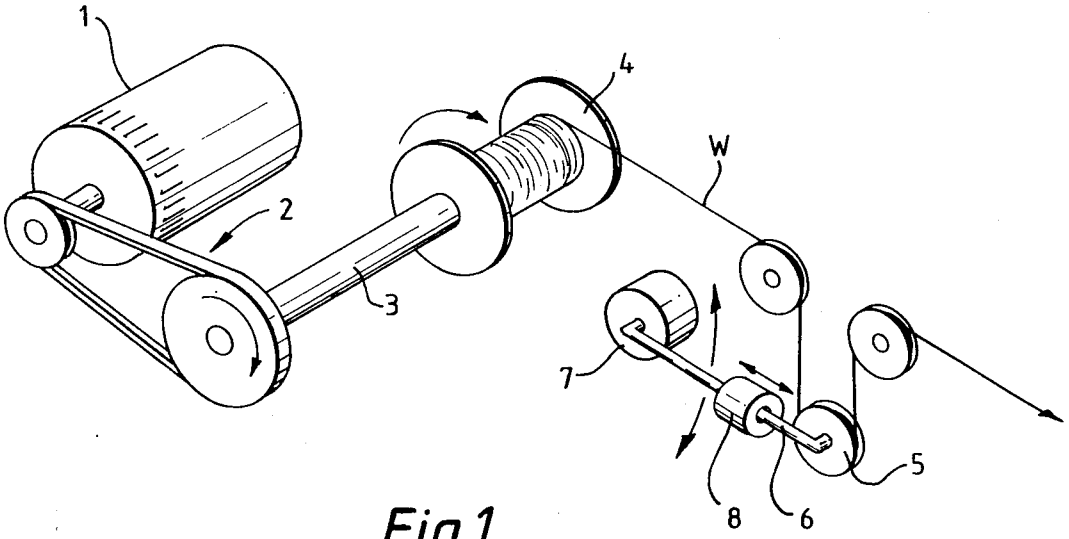
FIG. 1 is a schematrc view of apparatus for controlling the tension of a filamentary material being unwound from a drum for use in a subsequent process.

The apparatus shown in FIG. 1 comprises a three phase AC induction motor 1 coupled via a belt and pulley 2 to an output shaft 3 carrying a drum or spool 4 from which fibre or other flexible material W is being unwound at constant tension.

A sensing device for sensing the tension of the travelling material W comprises a V-groove pulley 5 around which the fibre moves, to which is attached a dancer arm 6 operating on a potentiometer 7.

A balance weight 8 is slidable along the dancer arm 6 in order to provide tension in the travelling fibre or other flexible material, and by sliding the weight 8 backwards or forwards along the dancer arm, this tension may be reduced or increased as necessary.

Another method to produce variable tension would be to spring load the dancer arm 6 by an adjustable spring device (not shown).

Additionally although a potentiometer 7 is described as the means for detecting and outputing a signal indicative of variation in tension from the prescribed value, nevertheless it is possible to use other transducers such as inductors, capacitors or a combination of the same to perform a similar function, as will be appreciated by those skilled in the appropriate art.

Figure 2:
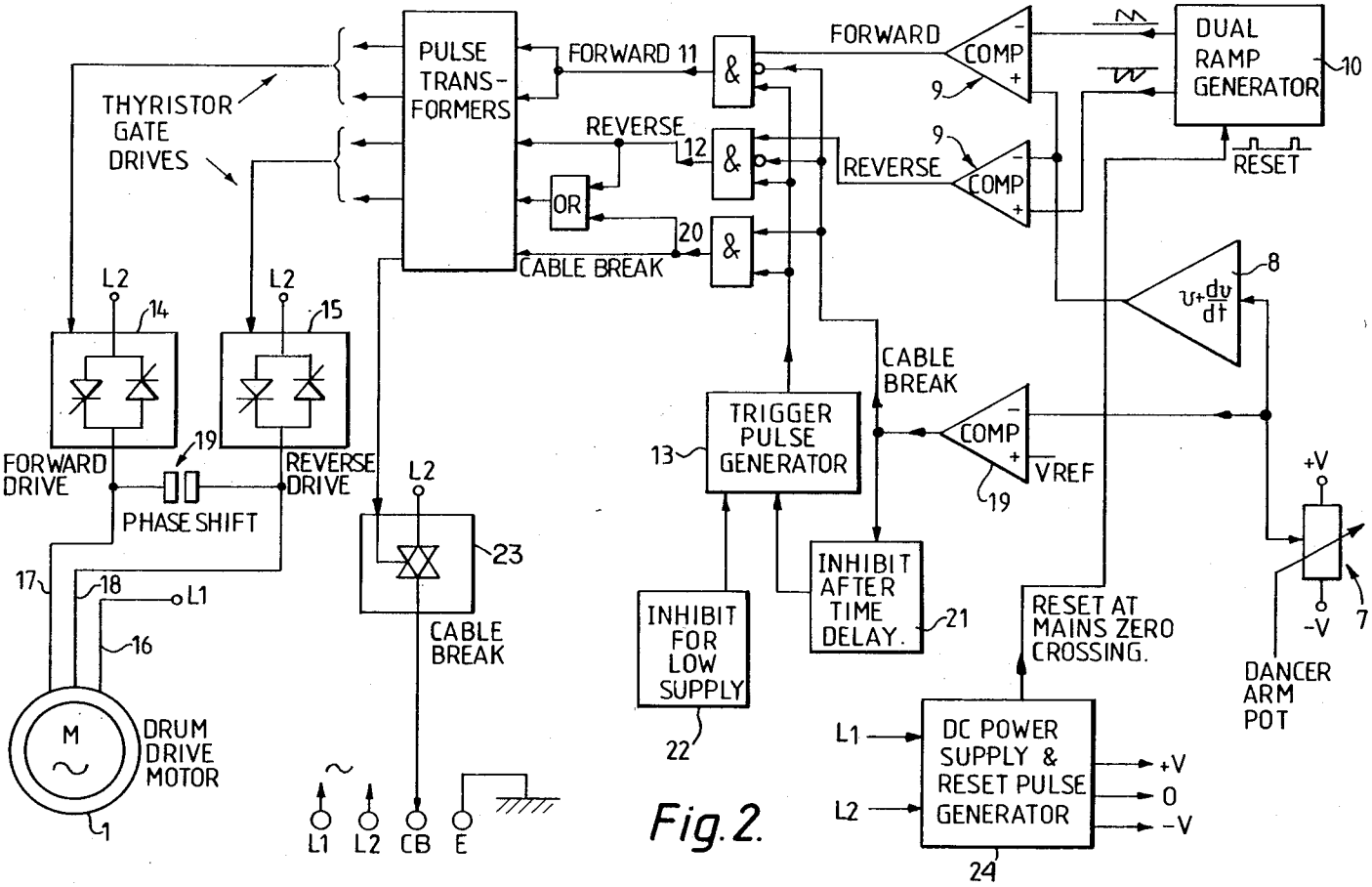
FIG. 2 is a diagram of a suitable circuit for operating the apparatus of FIG. 1.

With reference to the electronic circuit diagram in FIG. 2, the potentiometer 7 outputs an error signal representative of variation in tension in the material W from the prescribed value The error signal has proportional and derivative gain terms applied to it in amplifier 8 and is then compared by comparators 9 with two ramp wave forms from dual ramp generator 10 one for forward and one for reverse rotation of the motor 1.

The output from either one of the comparators 9 is a variable mark-space ratio dependent upon the amplitude of the error signal from the potentiometer 7.

This is combined at logic gates 11 and 12 with a pulse from trigger pulse generator 13 which is used to trugger an appropriate thyristor bank 14, 15 for forward and reverse drive of the motor 1.

The three phase motor 1 has one phase 16 connected directly to one side of a mains supply Ll, the other two phases 17, 18 being controlled by the thyristor banks 14, 15 respectively connected to the other side L2 of the mains supply.

The third phase required for the three phase induction motor is provided by phase shift capacitor 19 to operate the motor 1 in forward and reverse drive depending upon which thyristor bank 14, 15 is energised.

In a situation where the fibre W breaks, the dancer arm 6 falls to its lowest position and this is detected by a comparator 19.

This causes a DC current to flow through the motor 1 by triggering one only of the thyristors 15 through logic gate 20 thereby rapidly stopping the motor 1.

A few seconds after the dancer arm 6 has dropped, the triggering pulse from one of the thyristors 15 are cut off from the motor 1 by the time circuit 21. The circuit 22 is provided to detect when the mains voltage falls below a predetermined level which cuts off any trigger impulses to the motor 1.

Additionally a triac 23 is triggered to provide an output for operating an alarm or similar device (not shown).

A DC power supply 24 provides a positive and negative voltage feeding the dancer arm potentiometer 7 and control circuit electronics.

As explained earlier the motor 1 is a modified induction motor where the rotor is designed to have a high resistance. This is necessary to change the torque speed characteristics of the motor so that torque falls with increasing speed. The normal induction motor characteristic is one of increasing torque with speed up to approximately 80% of synchronous speed, then the torque decreases torwards zero. This implies that a normal induction motor has to be used above 80% of the synchronous speed to achieve stable operation.

In a normal induction motor which is operating at a high slip frequency the rotor appears primarily as an inductance. This causes the magnetic field created by the rotor current to be out of phase with the field induced by the stator.

This problem is overcome by increasing the inherent rotor resistance so reducing the degree of phase shift in rotor current at high slip frequency.

I claim:

1. Apparatus for controlling the tension of travelling flexible materials during winding and unwinding processes comprising, an A.C. three phase induction electric motor coupled to a spool to rotate said spool, said spool having flexible material wound thereon and travelling flexible material extending from said flexible material on said spool, detector means for detecting changes in the tension of said travelling flexible material from a prescribed tension value, said detector means producing a signal representative of variation in the tension of said travelling flexible material from the prescribed tension value, control means for receiving said signal and operatively responsive to said signal to control the rotation of said electric motor to thereby maintain said tension of said travelling material at said prescribed tension value, and said control means includes a pair of thyristor banks selectively operable in response to said signal to effect rotation of said induction motor in a predetermined rotational direction to attain said prescribed tension value, said thyristor banks operable to vary the torque of said motor in said predetermined rotational direction to restore said tension of said travelling flexible material to said prescribed tension value by varying a voltage between a pair of phase windings of said motor connected between said thyristor banks.

2. Apparatus as claimed in claim 1 wherein, two phases of said three phase motor are connected respectively to the output of each said thyristor bank and further connected by a capacitor means to effect rotation of said motor in said predetermined rotation direction.

3. Apparatus as claimed in claim 1 in which said detector means includes, a potentiometer for providing said signal representative of variation in the tension of said travelling flexible material from said prescribed tension value, and said apparatus further comprises processing means for processing said signal to provide a train of pulses to trigger an appropriate one of said thyristor banks in response to said signal.

4. Apparatus as claimed in claim 3 wherein said processing means includes, comparator means for comparing said signal with other signals provided by a dual ramp generator, said comparator means generating a variable mark-space ratio output waveform dependent upon the amplitude of said signal, and logic gate means for receiving said mark-space ratio waveform and combining said waveform with a pulse train provided from a trigger pulse means to trigger the appropriate thyristor bank depending upon the sense of said signal.

5. Apparatus as claimed in claim 1, wherein, said motor has a rotor of high resistance to effect a torque speed characteristic of decreasing torque with increased rotational speed.

6. Apparatus as claimed in claim 1 wherein, a thyristor in one of said thyristor banks is triggerable by cablebreak detector means to input a D.C. current to said motor to stop said rotation of said spool upon occurrence of a break in said travelling flexible material.

* * * * *